US010139109B2

(12) United States Patent
Thackway et al.

(10) Patent No.: US 10,139,109 B2
(45) Date of Patent: Nov. 27, 2018

(54) CAN-ANNULAR COMBUSTOR BURNER WITH NON-UNIFORM AIRFLOW MITIGATION FLOW CONDITIONER

(71) Applicant: Siemens Energy, Inc., Orlando, FL (US)

(72) Inventors: Richard L. Thackway, Oviedo, FL (US); Charalambos Polyzopoulos, Orlando, FL (US); James M. Hurney, Port Orange, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 360 days.

(21) Appl. No.: 14/989,829

(22) Filed: Jan. 7, 2016

(65) Prior Publication Data

US 2017/0198912 A1 Jul. 13, 2017

(51) Int. Cl.

| | |
|---|---|
| ***F23R 3/06*** | (2006.01) |
| ***F23R 3/28*** | (2006.01) |
| ***F23R 3/10*** | (2006.01) |
| ***F23R 3/46*** | (2006.01) |

(52) U.S. Cl.

CPC ..... *F23R 3/06* (2013.01); *F23R 3/10* (2013.01); *F23R 3/286* (2013.01); *F23R 3/46* (2013.01)

(58) Field of Classification Search

CPC .... F23R 3/06; F23R 3/10; F23R 3/286; F23R 3/46

See application file for complete search history.

(56) References Cited

U.S. PATENT DOCUMENTS

| | | | | |
|---|---|---|---|---|
| 5,363,653 | A * | 11/1994 | Zimmermann | F01D 9/023 60/751 |
| 6,615,588 | B2 * | 9/2003 | Hoecker | F23R 3/04 165/168 |
| 7,762,074 | B2 | 7/2010 | Bland et al. | |
| 2008/0041058 | A1 * | 2/2008 | Johnson | F23R 3/286 60/725 |

(Continued)

FOREIGN PATENT DOCUMENTS

DE 102010016460 A1 1/2011

OTHER PUBLICATIONS

PCT International Search Report and Written Opinion of International Searching Authority dated Jun. 27, 2017 corresponding to PCT International Application No. PCT/US2016/066307 filed Dec. 13, 2016.

*Primary Examiner* — Craig Kim

(57) ABSTRACT

Can-annular burners for gas turbine engines with flow conditioners having locally varying, asymmetrical patterns of circumferential perforations, to promote uniform fuel-air mixture among all premixers in the burner basket. Any one or more of the perforation pattern, pattern density, perforation profiles and perforation cross sectional area is locally varied to alter circumferential airflow into the burner basket, which in turn mitigates non-uniform thru-flow variations across the burner's air inlet plane. In some embodiments, the flow conditioner asymmetric perforation patterns are tailored for individual burner locations within the engine's combustor section annular ring, which mitigates non-uniform thru-flow variation among different respective burners in the combustor section annular ring. Thru-flow uniformity within each burner and among all the combustor section burners promotes uniform engine combustion.

8 Claims, 6 Drawing Sheets

(56) References Cited

U.S. PATENT DOCUMENTS

| | | | | |
|---|---|---|---|---|
| 2010/0275601 | A1 | 11/2010 | Berry et al. | |
| 2012/0006029 | A1* | 1/2012 | Bilbao | F23R 3/14 60/737 |
| 2012/0011854 | A1* | 1/2012 | Khan | F23R 3/04 60/772 |
| 2014/0338354 | A1 | 11/2014 | Stewart et al. | |

* cited by examiner

CAN-ANNULAR COMBUSTOR BURNER WITH NON-UNIFORM AIRFLOW MITIGATION FLOW CONDITIONER

The entire disclosure of U.S. Pat. No. 7,762,074, issued on Jul. 27, 2010, and entitled "Air Flow Conditioner for a Combustor Can of a Gas Turbine Engine" is hereby incorporated by reference in its entirety.

TECHNICAL FIELD

The invention relates to can-annular burner-type combustors that are used in combustion turbine engines. The engines are also commonly referred to as gas turbine engines. More particularly, the invention relates to can-annular burners with flow conditioners having locally varying, asymmetrical patterns of perforations that mitigate non-uniform thru-flow variations across the burner's air inlet plane. In some embodiments, the flow conditioners mitigate non-uniform thru-flow variations among different respective burners in the annular ring of the engine's combustor section.

BACKGROUND

As described in the incorporated-by-reference U.S. Pat. No. 7,762,074, gas turbine engines having can-annular burner-type combustors are known, wherein individual cans feed hot combustion gas into respective individual portions of an arc of a turbine section inlet. Each can typically includes a basket, which circumscribes and retains a main burner having a plurality of premixers, which are also commonly referred to as preswirlers, disposed in an annular ring around a central pilot burner, for premixing fuel and air. The premixers receive respective portions of a flow of compressed air from the engine's compressor section, along with respective portions of a fuel flow. The respective portions of the fuel flow are discharged by fuel outlets disposed within the premixers to form a fuel-air mixture that moves through the combustor basket in a thru-flow direction for combustion in the downstream combustion zone.

The combustor basket's thru-flow airflow profile is evaluated along an air inlet plane, which is oriented perpendicular to the thru-flow direction, upstream of the premixers. For example, in a cylindrical or frusto-conical profile combustor basket, the air inlet plane is oriented perpendicular to the basket central axis upstream of the premixers. An airflow reversal region is oriented in the combustor basket on the upstream of the air inlet plane and the premixers relative to the thru-flow direction. The airflow reversal region regulates the thru-flow airflow pressure by allowing regulated, circumferential entry or intake of compressor air upstream of the air inlet plane, from outside the basket. In this known type of combustor, the compressed air flows in a reverse flow direction (relative to the thru-flow direction) around the exterior of the basket. The compressor-supplied airflow entry into the airflow reversal region is sometimes regulated by a flow conditioner that circumscribes the combustor basket airflow reversal region. The flow conditioner has a pattern of perforations, the cross sectional area of which regulates compressor airflow entering the basket. Reverse airflow into the combustor basket and thru-flow specifications are established for a gas turbine engine. Ideally, the airflow profile of the fuel-air thru-flow is constant across the entire combustor basket air inlet plane. Therefore, in the past, perforation patterns of flow conditioners have been symmetrical along the flow conditioner's circumferential surface to facilitate uniform reverse airflow from the compressor into the annular combustor basket, which was complimentary to the presumed ideal fuel-air mixture thru-flow uniform flow pattern across the air inlet plane.

While ideally, fuel-air thru-flow across a combustor basket's air inlet plane should be uniform; in reality, they experience non-uniform thru-flow. The incorporated-by-reference U.S. Pat. No. 7,762,074, describes experiments, which determined that airflow rates through respective premixers of the main burner of an individual can might vary by as much as 7.5% from an average flow rate among the premixers. The same patent states that such a variation may create temperature differentials of +/−75 degrees centigrade among the premixers when operating the gas turbine is operating at base load. These temperature differentials may result in more oxides of nitrogen (NOx) production by the relatively hotter areas of the burner associated with premixers receiving a relatively lower than average airflow and more carbon monoxide (CO) production by the relatively cooler areas of the burner associated with premixers receiving relatively more than average airflow. The incorporated-by-reference U.S. Pat. No. 7,762,074, describes a uniform, symmetrical perforation pattern of slots formed in the combustor basket flow conditioner circumference that mitigates airflow differences among premixers in a combustor can, resulting in improved combustion characteristics, such as reduced emissions.

SUMMARY

In exemplary embodiments described herein, can-annular burner-type combustors for gas turbine engines include flow conditioners having locally varying, asymmetrical patterns of circumferential perforations, to promote uniform fuel-air mixture among all premixers in the burner basket. Any one or more of the perforation pattern, pattern density, perforation profiles and perforation cross sectional area is locally varied to alter circumferential airflow into the burner basket, which in turn mitigates non-uniform thru-flow variations across the burner's air inlet plane. For example, where the localized thru-flow is lower than desired, the localized perforation pattern is configured to increase circumferential airflow into the basket, i.e., by increasing perforation cross section by one or more of hole shape, hole size, and/or pattern density. Conversely, localized perforation cross section is decreased to reduce localized thru-flow.

Uniform thru-flow across the burner's entire air inlet plane promotes more consistent fuel-air ratio, and in turn more consistent combustion, so that the burner meets combustion specifications. Uniform through-flow across the burner's entire air inlet plane also mitigates combustion flare-ups or "hot spots", which might otherwise damage combustor components. In some embodiments, the respective flow conditioner perforation patterns are tailored for individual burner locations within the engine's combustor section annular ring, which mitigates non-uniform thru-flow variation among different respective burners in the combustor section annular ring, caused by local variations in compressor airflow about the annular ring. Thru-flow uniformity within each burner and among all the combustor section burners that are constructed in accordance with the embodiments described herein, promotes uniform engine combustion, attainment of combustion performance and atmospheric emission specifications, while reducing potential damage to combustor section components.

Exemplary embodiments of the invention feature a can-annular burner-type combustor for a gas turbine engine, which includes a basket having a basket circumferential outer wall, defining therein a compressed air and fuel axial thru-flow path, with a thru-flow path flow direction, across an air inlet plane. An airflow reversal region is oriented upstream of the air inlet plane, relative to the thru-flow flow direction. A plurality of premixers are annularly arrayed about a pilot burner, all of which are oriented within the basket interior downstream of the air inlet plane, within and relative to the thru-flow path flow direction. A flow conditioner is coupled to the basket upstream of the air inlet plane, relative to the thru-flow path flow direction, circumscribing the airflow reversal region. The flow conditioner defines an asymmetrical pattern of circumferential perforations that vary circumferential airflow locally from outside the basket into the airflow reversal region. The perforation pattern is configured to mitigate flow pattern variations in the thru-flow path across the air inlet plane.

Other exemplary embodiments of the invention feature a gas turbine engine, which includes a combustor section having a plurality of circumferentially oriented can-annular burner-type combustors. Each burner respectively has a basket incorporating a basket circumferential outer wall. The basket defines therein a compressed air and fuel axial thru-flow path, having a thru-flow flow direction, across an air inlet plane and an airflow reversal region upstream of the air inlet plane, relative to the thru-flow flow direction. A plurality of premixers are annularly arrayed about a pilot burner, all of which are oriented within the basket interior downstream of the air inlet plane relative to the thru-flow flow direction, and within the thru-flow path. A flow conditioner is coupled to the basket upstream of the air inlet plane, which circumscribes the airflow reversal region. The flow conditioner defines an asymmetrical pattern of circumferential perforations that vary circumferential airflow locally from outside the basket into the airflow reversal region. The respective asymmetric perforation pattern of each respective burner is configured to mitigate flow pattern variations in the thru-flow path across its respective air inlet plane, and to mitigate flow pattern variations in the thru-flow path among all other burners in the combustor section.

Additional exemplary embodiments of the invention feature a method for regulating airflow within gas turbine engine burner-type combustors. The provided gas turbine engine includes a combustor section having a plurality of circumferentially oriented can-annular burners. Each respective burner has a basket, with a basket circumferential outer wall, defining therein a compressed air and fuel axial thru-flow path across an air inlet plane. The thru-flow path has a thru-flow flow direction. An airflow reversal region is oriented upstream of the air inlet plane, relative to the thru-flow path flow direction. A plurality of premixers are annularly arrayed about a pilot burner, all of which are oriented within the basket interior downstream of the air inlet plane, relative to the thru-flow flow path direction, and within the thru-flow path. A flow conditioner is coupled to the basket upstream of the air inlet plane, circumscribing the airflow reversal region. The flow conditioner defines an asymmetrical pattern of circumferential perforations that vary circumferential airflow locally from outside the basket into the airflow reversal region. Uniform thru-flow path and overall circumferential airflow flow rate specifications common to all of the burners are established, for achieving defined engine fuel-air ratio combustion parameters. Actual flow pattern variations are determined (by physical measurement or in virtual simulation) in the respective thru-flow path for each respective burner across its respective air inlet plane. A respective flow conditioner perforation pattern is determined for each respective burner, which will mitigate thru-flow path airflow rate variations. The perforation pattern may require deviating from the established overall circumferential airflow flow rate specification, if necessary, to normalize thru-flow rates of burners in different locations about the combustion ring. Respective flow conditioners incorporating respective determined perforation pattern are fabricated, for installation in the gas turbine engine The respective features of the exemplary embodiments of the invention that are described herein may be applied jointly or severally in any combination or sub-combination.

BRIEF DESCRIPTION OF DRAWINGS

The exemplary embodiments of the invention are further described in the following detailed description in conjunction with the accompanying drawings, in which.

To facilitate understanding, identical reference numerals have been used, where possible, to designate identical elements that are common to the figures. The drawings are not drawn to scale.

DESCRIPTION OF EMBODIMENTS

Exemplary embodiments of the invention are utilized in can-annular burner-type combustors for gas turbine engines. These burners include flow conditioners having locally varying, asymmetrical patterns of circumferential perforations, to promote uniform fuel-air mixture among all premixers in the burner basket. Any one or more of the perforation pattern, pattern density, perforation profiles and perforation cross sectional area is locally varied to alter circumferential airflow into the burner basket, which in turn mitigates non-uniform thru-flow variations across the burner's air inlet plane. In some embodiments, the flow conditioner perforation patterns are tailored for individual burner locations within the engine's combustor section annular ring, which mitigates non-uniform thru-flow variation among different respective burners in the combustor section annular ring. Thru-flow uniformity among the premixers within each respective burner and common thru-flow uniformity among all the combustor section burners within an engine promotes uniform engine combustion.

General Overview of Can-Annular Combustor Non-Uniform Airflow

Figure 1:
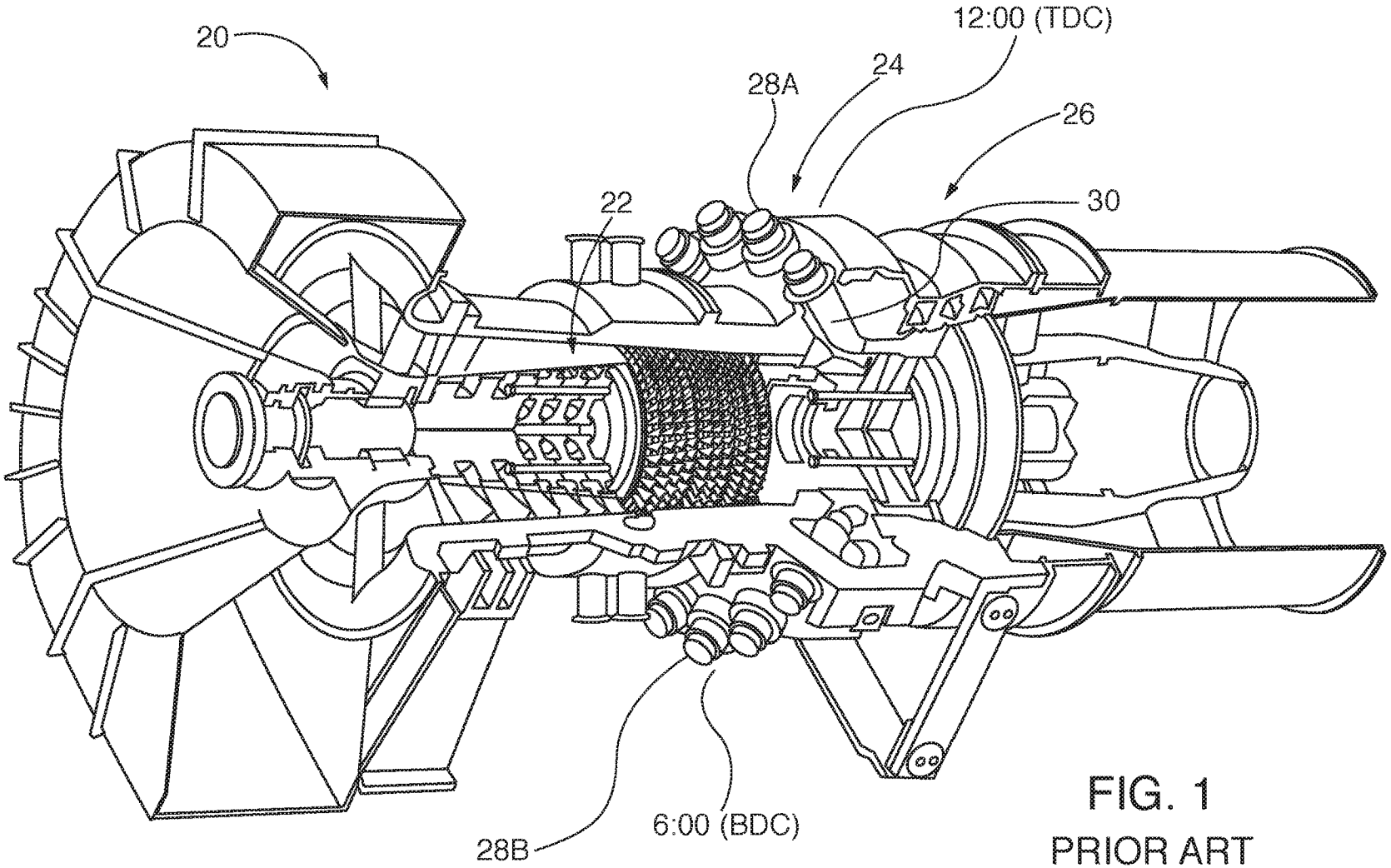
FIG. 1 PRIOR ART
FIG. 1 is a quarter-sectioned perspective schematic view of a prior art combustion or gas turbine engine, showing a can-annular burner-type combustors oriented annularly about a combustion section annular ring.
Figure 2:
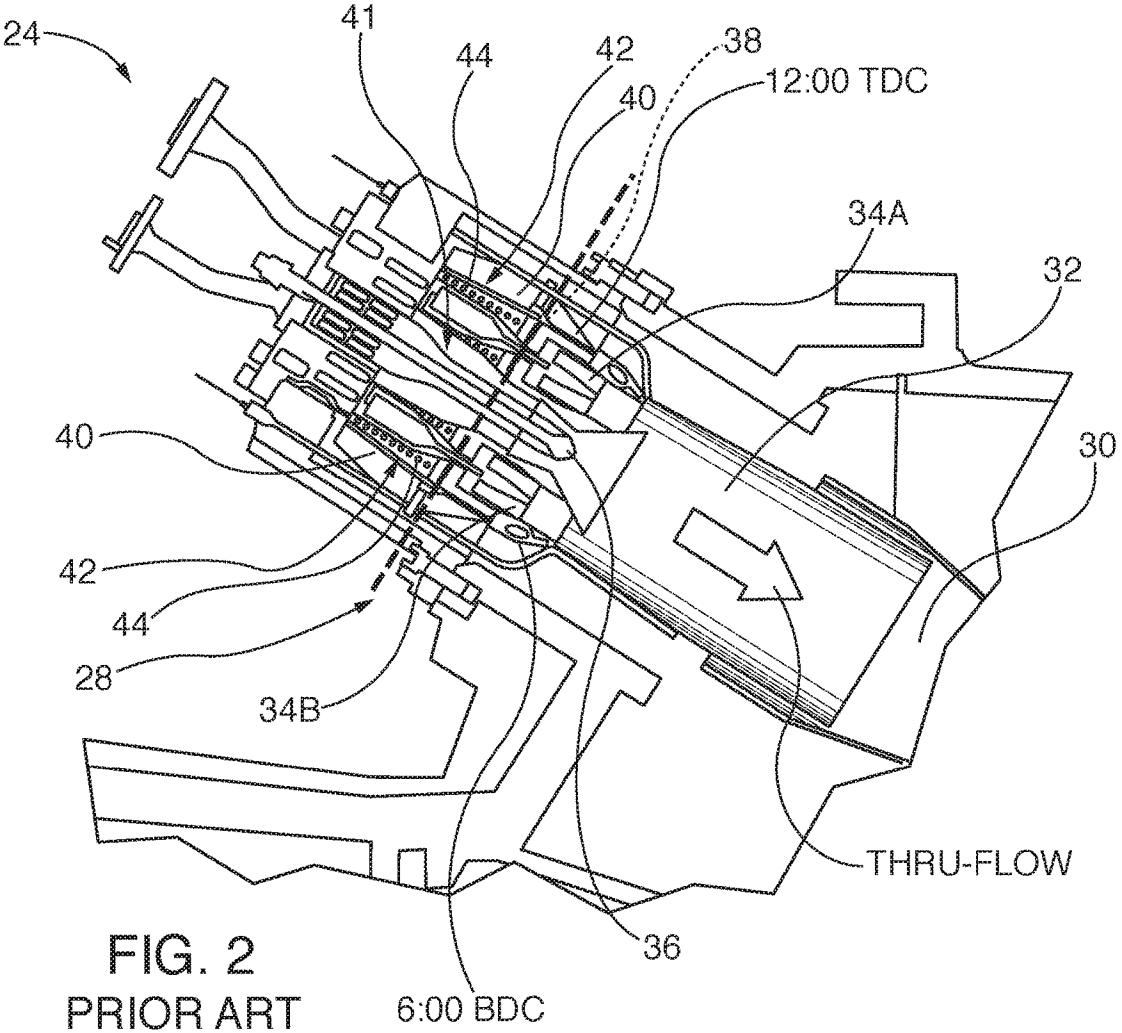
FIG. 2 PRIOR ART
FIG. 2 is a partial cutaway, schematic elevational view of a prior art can-annular burner-type combustor and transition in the combustor section of the gas turbine engine of FIG. 1.

By way of brief general overview, FIGS. 1 and 2 shows an exemplary known combustion turbine engine 20, which is also commonly referred to as a gas turbine engine. The engine 20 has a compressor section 22, a combustion section 24 and a turbine section 26. The combustion section 24 includes an annular ring of can-annular burner-type combustors 28. Each combustor 28 is respectively coupled to the compressor section 22 by an exit diffuser, to a fuel source, such as natural gas. The combustor 28 is coupled to the turbine section 26 by a downstream mating transition 30. In FIG. 2, the combustor or burner 28 is shown in partial axial cross section, and comprises a combustor basket 32, in which is annularly arrayed a plurality of separate premixers or preswirlers 34 that receive compressed air from the compressor exit diffuser and entrain metered fuel into the compressed air, in accordance with a fuel-air ratio. The entrained fuel and compressed air mixture travel in the thru-flow direction, shown by the broad arrow, and are ignited by the pilot burner 36. The combustion gasses are routed in the thru-flow direction to the turbine section 26 by the transition 30. An air inlet plane 38 is defined in a cross section that is perpendicular to the thru-flow flow direction. When, as shown, the combustor basket 32 has a conical frustum or cylindrical profile, the air inlet plane is perpendicular to the combustor basket central axis. The combustor basket 32 has a plurality of basket arms 40, which extend axially upstream of the air inlet plane 38, opposite the thru-flow flow direction. An airflow reversal region 41 is established in the zone within combustor basket 32 that is upstream of the air inlet plane 38. Gaps between the basket arms 40 provide a circumferential entry path for compressor airflow, surrounding the outside the basket 32, to enter the basket upstream of the air inlet plane 38, i.e., opposite the thru-flow flow direction. The circumferentially introduced, reverse airflow from the compressor causes a pressure loss, which is regulated by a flow conditioner 42 that is coupled to the combustor basket 32 and basket arms 40, and circumscribes the airflow reversal region 41. Generally, the fuel-air mixture flame front is downstream of the air inlet plane 38, in order to avoid thermal damage to the premixers 34, pilot burner 36, basket arms 40, and the flow conditioner 42.

The known flow conditioner 42 defines a circumferentially uniform pattern of perforations 44. The perforation pattern 44 cross section regulates the circumferentially introduced, reverse airflow. The uniform perforation pattern of known flow conditioners is thought to promote uniform circumferential airflow and in turn uniform thru-flow airflow across the air inlet plane 38. The incorporated-by-reference U.S. Pat. No. 7,762,074 states that the reverse airflow is typically non-uniformly distributed circumferentially about the outside of the combustor basket in the airflow reversal region. Its invention is directed to a uniform pattern of elongated slot perforations formed in the flow conditioner, (e.g., slot perforations 92 and 96 of FIG. 3 therein), in order to mitigate airflow variations between respective premixers in the combustor basket that are downstream of the air inlet plane 38. Elongated slots allow easier air flow reversal versus round holes.

While ideally during engine design, fuel-air thru-flow across respective air inlet planes is assumed to be identical and constant among all can-annular combustors in a turbine engine, in reality the present inventors have observed—through computational fluid dynamic virtual studies and by empirical observation—that combustors experience uneven or non-uniform airflows within one or more of the respective burner cans in the combustor annular ring. For example, referring to the exemplary known turbine engine of FIG. 1, in some turbine engines the combustor 28A and its lateral neighbors in the combustion section 12:00 or top dead center (TDC) zone have more compressed air inflow from the compressor section 22 than combustor 28B and its lateral neighbors in the combustion section 6:00 or bottom dead center (BDC) zone. Also, within any specific can's combustor basket, its array of premixers may also experience uneven or non-uniform airflows in the fuel-air mixture thru-flow among its respective premixers, as well as variations of circumferential airflow entering the combustor basket through the flow conditioner. For example, referring to FIG. 2, in some can-annular burners, the premixer 34A in the 12:00 or top dead center (TDC) position within the combustor basket 32 has more compressed air inflow from the compressor section 22 than premixer 34B and the same combustor basket's 6:00 or bottom dead center (BDC) position.

The flow conditioner 42 symmetrical circumferential perforation pattern 44 provides capacity for a uniform pressure drop into the combustor basket 32 across the air inlet plane 38. However, air exiting the compressor exit diffuser creates a highly turbulent and complex flow field, which combined with structural restrictions of compressed air passages in the combustion section, does not evenly distribute the compressed air within the combustor annular array to each combustor basket's thru-flow. As a result, each of the premixers 34 receives different airflow. The same complex compressed air flow field and compressed air passages constraints fail to provide uniform circumferentially directed airflow from outside the combustor basket 32, through the flow conditioner perforations 44 into the airflow reversal zone 41. When supply of circumferential, compressed airflow is not uniform about the flow conditioner 42 outer circumference there will be different localized airflow profiles into the uniformly distributed, symmetrical perforations 44. As a result, some of the premixers 34 receive more air reverse flow air than others, due to localized variations in the reverse airflow across the air inlet plane 38.

The inventors have observed ramifications of non-uniform thru-flow airflow patterns on turbine engine combustion. When equal quantities of fuel are supplied to each premixer 34, (e.g., natural gas supply pressure equal to each premixer), this creates circumferentially varying fuel-air ratio (FAR) distributions among the premixers 34A, 34B, etc., within an individual combustor burner 28 and among other burners 28A, 28B, etc., around the combustion section annular ring. Disparate FARs among different premixers 34 manifests several undesirable localized effects. Generally, higher FAR results in a cooler flame which can undesirably increase CO in the combustion gas. Conversely, lower FAR increases flame temperature, which increases NOx in the combustion gas. Supplying less air to a premixer 34 than the compressed air requirement specification also results in a lower air velocities and when fuel is mixed the resulting flame is brought upstream towards the premixers (due to a lower mixture velocity). This flame movement creates hot streaks in the combustor basket 32, and can overheat the burner. Empirically the inventors have observed that more combustor basket 32 overheating damage occurs at the 6:00 or bottom dead center (BDC) location of combustors 28 than any other location. It is therefore desirable, in terms of both emissions and combustor 28 hardware longevity, that a uniform airflow across the entire air inlet plane 38. Uniformly circumferentially distributed, symmetrical perforation flow conditioners do not provide airflow control capabilities to address localized variations in the airflow across the air inlet plane, because the uniform pattern cannot locally redistribute the non-uniform circumferential airflow entering from the basket exterior through the flow conditioner.

Can-Annular Burner with Asymmetrical Flow Conditioner Perforation Pattern

Exemplary embodiments of the present invention can-annular burner construction provide for localized regulation of circumferential airflow entry into the combustor basket by locally varying perforation pattern of the flow conditioner. In some embodiments, the perforation pattern is varied for localized regulation of airflow across the air inlet plane among respective premixers within an individual combustor basket. In other embodiments, the perforation pattern is varied among different can-annular burner locations within a combustion section annular combustor ring, so that collectively variation of airflow patterns of all the burners is mitigated to achieve an overall combustor basket thru-flow specification (i.e., increase thru-flow rate for combustor locations in the combustor ring that are below a thru-flow specification and decrease thru-flow for those that exceed the specification). In some embodiments, the perforation pattern is varied to mitigate both localized variance of thru-flow within a single burner's combustor basket and thru-flow variance among the several burners arrayed about the combustor section within the engine.

Figure 3:
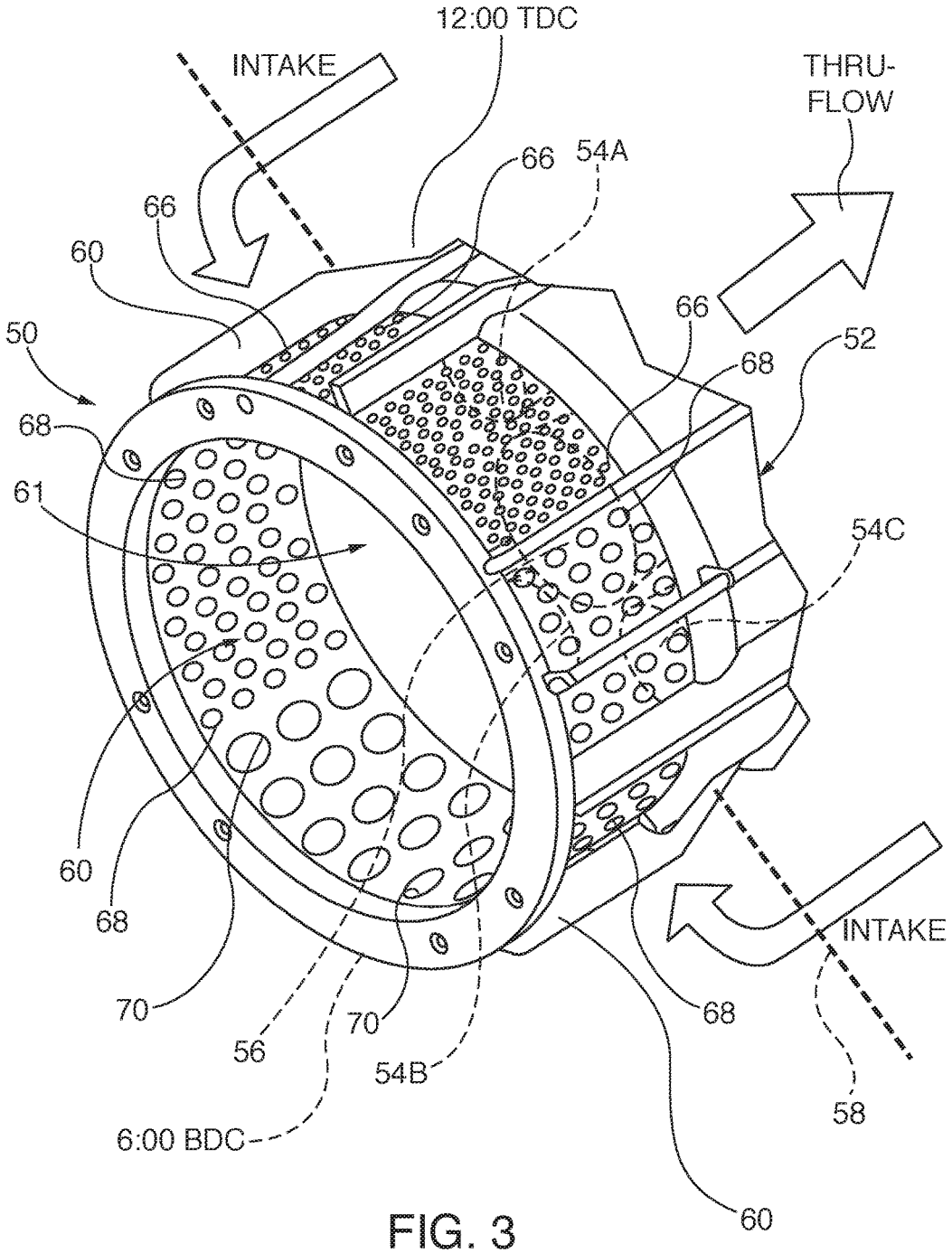
FIG. 3 is a perspective view of a can-annular combustor, in accordance with an embodiment of the invention, wherein the combustor basket flow conditioner has an exemplary asymmetrical perforation pattern that varies about the basket circumference, e.g., top dead center (TDC or 12:00 circumferential position) and bottom dead center (BDC or 6:00 circumferential position)

Turning now to the gas turbine engine can-annular burner embodiment of FIG. 3, the can-annular burner 50 includes a combustor basket 52, having a basket circumferential outer wall, defining therein a compressed air and fuel axial thru-flow path, with a thru-flow path flow direction, denoted by the double arrow, across an air inlet plane 58. An airflow reversal region 61 is oriented upstream of the air inlet plane 58, relative to the thru-flow flow direction. A plurality of premixers 54 are annularly arrayed about a pilot burner 56, all of which are oriented within the basket 52 interior downstream of the air inlet plane 58, within and relative to the thru-flow path flow direction. More particularly, premixer 54A is oriented in the combustor basket 52's TDC or 12:00 position; premixer 54B is oriented in the combustor basket 52's BDC or 6:00 position opposite the premixer 54A; and premixer 54C is oriented annularly intermediate the premixers 54A and 54B. Basket arms 60 extend axially upstream (relative to the thru-flow flow direction) along the combustor basket 52, forming an airflow reversal region 61. Generally, the aforementioned described components of the burner 50 in this paragraph are of known construction, and similar to those of the previously described known combustor burner 28.

Figure 4:
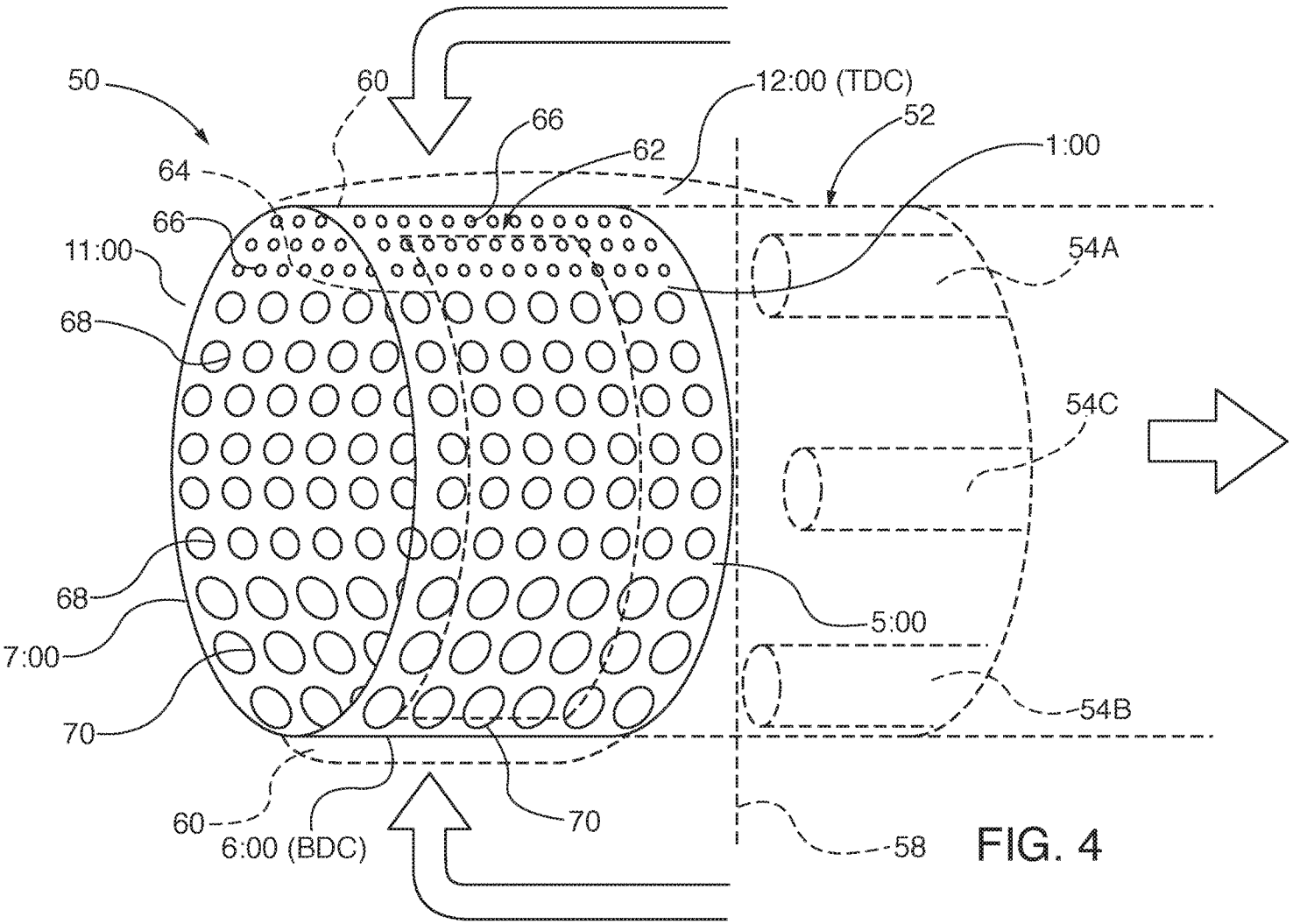
FIG. 4 is a perspective view of the combustor of FIG. 3, showing in greater detail the exemplary circumferentially-asymmetrical perforation pattern formed about the flow conditioner circumference, for locally varying circumferential airflow into the combustor basket.

Referring to FIGS. 3 and 4, the can-annular burner 50's flow conditioner 62 is coupled to the basket arms 60 and basket 52 upstream of the air inlet plane 58, relative to the thru-flow path flow direction, circumscribing the airflow reversal region 61. The flow conditioner 62 embodiment of FIGS. 3 and 4 differ from known flow conditioners, in that it locally regulates circumferential airflow from outside the combustor basket 52 into the airflow reversal region 61, through use of an asymmetrical circumferential perforation pattern 64. The asymmetrical perforation pattern 64 is configured to mitigate local flow pattern variations in the thru-flow path across the air inlet plane 58, by locally varying perforation cross sectional area, and thus capacity for the external pressurized compressor air to enter the airflow reversal region 61 circumferentially from outside the basket.

Viewing in a clockwise direction about the flow conditioner 62, the planform pattern 64 comprises small size circular holes 66 that are locally patterned in the 11:00 to 1:00, or top dead center (TDC) circumferential annular zone upstream of and proximate to the premixer 54A; intermediate size circular holes 68 that are larger than the circular holes 66 that are locally patterned in the 2:00 to 4:00 circumferential annular zone proximate the premixer 54C; and the largest size circular holes 70 that are locally patterned in the 5:00 to 7:00, or bottom dead center (BDC) circumferential annular zone proximate the premixer 54B. The intermediate size circular hole 68 pattern is repeated in the 8:00 to 10:00 circumferential annular zone. In this way, the BDC zone has greater circumferential airflow cross section than the opposite, opposed TDC zone airflow cross section, and the intermediate zones there between have airflow cross sections that are between those of the opposed TDC and BDC zones. Conversely, the airflow can be adjusted by either reducing the number of holes where there is adequate airflow and increasing the number of holes where more airflow is needed.

As a practical result of this perforation pattern 64 of FIGS. 3 and 4, the BDC zone of premixer 54B will receive more incoming circumferential airflow than the TDC zone's premixer 54A, which compensates for the inventor observed lower thru-flow in premixer 54B. Thus, variations in the thru-flow flow pattern across the air inlet plane 58 are mitigated by asymmetrically varying the local circumferential perforation pattern 64. As previously discussed, a can-annular burner's thru-flow pattern and flow rate of the fuel air mixture and the circumferential airflow from outside the combustor basket 52 into the airflow reversal region 61 are established by specifications, in order to achieve desired turbine engine emission and performance specifications. In the past flow conditioner designs, the respective airflows were theoretically achieved by use of a symmetrical perforation pattern flow conditioner. When practicing the present invention, with the asymmetrical planform perforation pattern, such as the flow conditioner 62's exemplary perforation pattern 64, combination of localized variations in the perforation pattern's circumferential airflow cross section do not exceed the total or overall circumferential-airflow design specification for the designated burner. In other words, increase in circumferential airflow cross section in one or more zones is accompanied by a related decrease in circumferential airflow cross section in other zones, so that overall circumferential airflow is within the designated specification.

Figure 5:
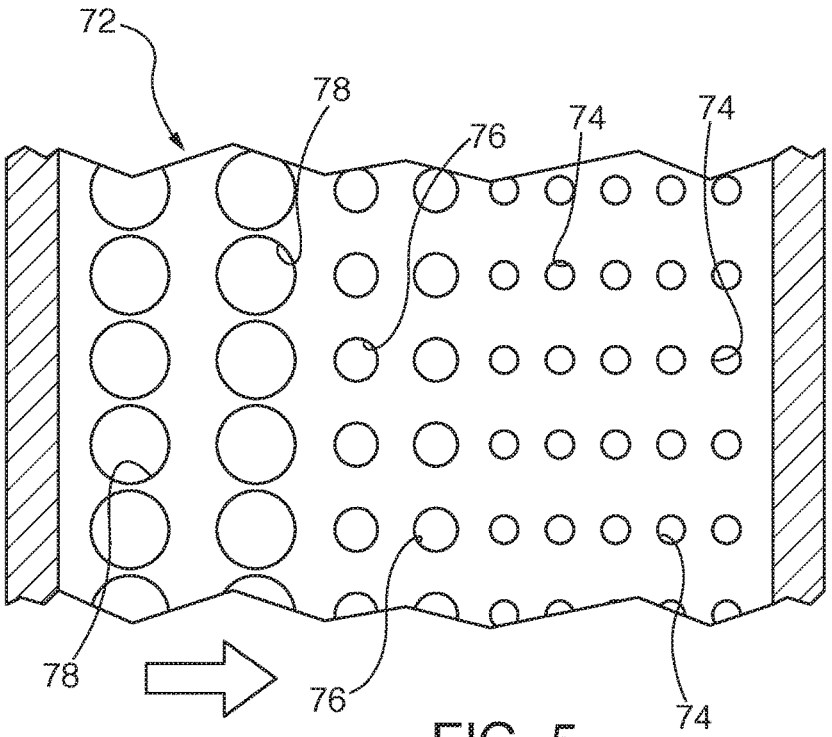
FIG. 5 is a fragmentary elevational view of another exemplary embodiment combustor basket flow conditioner, having an axially-asymmetrical perforation pattern formed therein, for locally varying circumferential airflow into the combustor basket.
Figure 6:
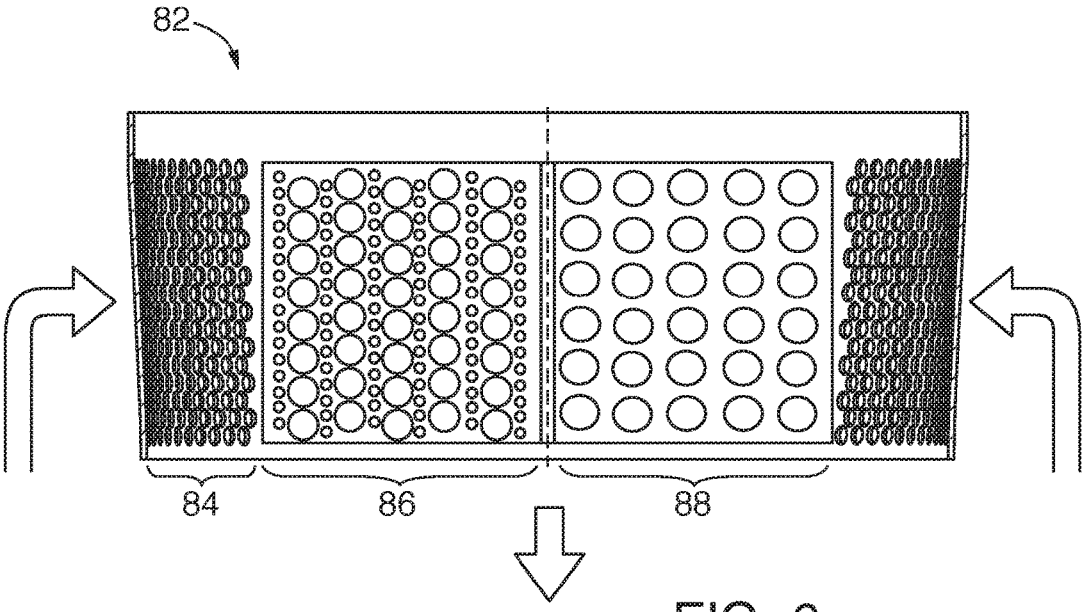
FIG. 6 is an exterior plan view of another embodiment of a combustor basket flow conditioner, having varying perforation hole patterns, spacing and pitch about its circumference, for locally varying circumferential airflow into the combustor basket.

The flow conditioner 72 embodiment of FIG. 5 has an asymmetrical perforation pattern of small holes 74, intermediate size holes 76, and largest holes 78 in the axial direction of the flow conditioner 72 surface. As shown in FIG. 6, the asymmetrical perforation pattern of the flow conditioner 82 is locally varied to achieve desired airflow cross sectional "porosity", by varying perforation cross sectional area, or perforation profile, or perforation density circumferentially and/or axially along the flow conditioner. The perforation pattern 84 has a high-density repeating pattern of small holes. The perforation pattern 86 combines holes of two alternating diameter, repeating rows, and having less pattern density than the perforation pattern 84. The perforation pattern 88 uses larger diameter holes than those of the perforation patterns 84 or 86, but spreads them in a wider pattern than the other two patterns. While round perforation holes have been illustrated in the figures herein, other shapes, such as the round edged slots of the incorporated-by-reference U.S. Pat. No. 7,762,074, trapezoids, or other polygonal shapes can be utilized to form the perforations. Round holes provide for relative easy manufacture and exhibit good resistance to mechanical and thermal stress in turbine engine combustion section applications, during heating and cooling cycles.

Method for Regulating Can-Annular Burner Localized Thru-Flow

Figure 7:
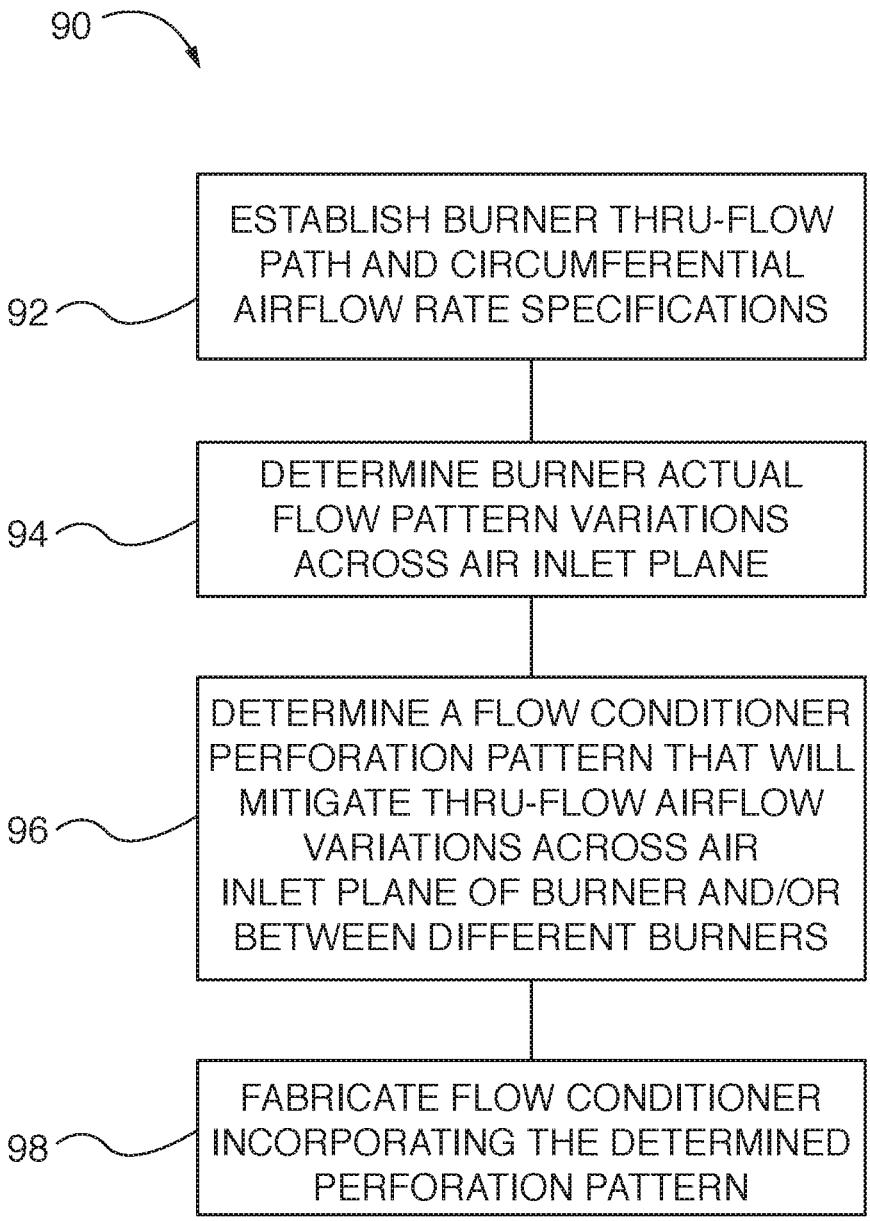
FIG. 7 is a flowchart showing an exemplary method for regulating airflow within a gas turbine engine by locally varying the combustor basket flow conditioner perforation pattern, in accordance with the present invention.

The exemplary overall method for regulating can-annular burner localized thru-flow, in order to mitigate localized airflow variations is now summarized, referring to the flow chart 90 of FIG. 7. In step 92, fuel-air ratio (FAR) specifications are established for achieving defined engine combustion parameters, such as CO and NOx emission levels, for a given gas turbine engine. The compressor air thru-flow and circumferential airflow specifications establish the intended combustion airflow parameters that are expected to be met by each individual combustor's can-annular burner. Fuel supply is adjusted based on the airflow parameters, generally by an engine monitoring and control system (not shown).

In step 94, actual flow pattern variations in the respective thru-flow path for each respective burner across its respective air inlet plane is determined by computational fluid dynamics (CFD) virtual simulations, observed actual flow measurement data, and other empirical data, such as examination of localized thermal damage to various in-service engine components. Flow pattern variations are determined for: (A) one or more of individual premixers within a specific can-annular burner combustor basket; and/or (B) different burner locations about the combustion section annular ring relative to other locations about the annular ring, where burners are not being fed the same thru-flow rates of compressed air from the compressor exit into the combustor basket; and/or (C) where circumferential compressed airflow into a combustor basket airflow reversal region is not uniform (e.g. for (B) or (C), TDC versus BDC burner positions).

Once actual flow rate variations are identified, in step 94, respective flow conditioner asymmetric perforation patterns are determined for each respective burner that will mitigate thru-flow path airflow rate variations, in step 96. In the case of burner location variations about the combustion section annular ring, deviations from the established overall circumferential airflow flow rate specification can be modified to normalize all burner thru-flow to meet the thru-flow specification. In this way, the flow conditioner perforation pattern for one or more individual combustor locations in the combustor ring is modified, if necessary, to mitigate thru-flow variations among different burner locations, and ideally achieve thru-flow normalization about the entire combustor ring. Thus, it may be advantageous to design more than one flow conditioner perforation pattern for a particular turbine engine design, with respective perforation patterns tailored to address variations in compressed airflow supplied to the individual burner location. Alternatively, a smaller number of flow conditioner perforation pattern designs, compromising performance improvements for a number of burner locations that have relatively similar airflow variations, may balance competing design goals of engine performance improvement versus manufacturing and service cost containment.

In practicing the flow conditioner perforation pattern determination step 96, the subject flow conditioner will use circumferentially varying hole sizes and patterns to increase or decrease the cross sectional area available to the air flowing circumferentially from outside the combustor basket into the airflow reversal region, and ultimately downstream, relative to the thru-flow flow direction, to the associated premixers. Where combustor basket airflow is lower than desired, the number of holes and/or size of holes, and/or hole pattern density, will be increased. This will create a locally lower pressure drop and allow more air to enter the basket through the flow conditioner perforations. Conversely, at locations where there is too much basket thru-flow air, the number of holes, and/or size of the holes, and/or hole pattern density will be decreased. This will create a locally higher-pressure drop and restrict air entering the basket through the perforations. The overall effective area of the flow conditioner circumferential airflow will be held constant, maintaining the design specification, therefore resulting in no adverse impact to engine performance. The resulting circumferentially varying pressure drop will redistribute the air, creating more uniform airflow through all basket premixers. However, as previously mentioned, if necessary, overall effective area of the flow conditioner circumferential airflow is modified at different combustor locations within the combustion ring, to normalize thru-flow variations that are attributable to non-uniform distribution of compressor air around the combustion section's combustor ring. Localized perforation pattern variation design for flow conditioners is accomplished through computational fluid dynamic (CFD) analysis simulation tools.

After the flow conditioner perforation pattern is designed, the flow conditioner is fabricated in step 98. Subsequently, the fabricated flow conditioner is tested in an actual engine or engine rig test to validate the design.

Although various embodiments that incorporate the invention have been shown and described in detail herein, others can readily devise many other varied embodiments that still incorporate the claimed invention. The invention is not limited in its application to the exemplary embodiment details of construction and the arrangement of components set forth in the description or illustrated in the drawings. The invention is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted", "connected", "supported", and "coupled" and variations thereof are used broadly and encompass direct and indirect mountings, connections, supports, and couplings. Further, "connected" and "coupled" are not restricted to physical, mechanical, or electrical connections or couplings.

What is claimed is:

1. A method for regulating airflow within a gas turbine engine burner, comprising:

providing a gas turbine engine, including a combustor section having a plurality of circumferentially oriented can-annular burners, each burner respectively having:

a basket having a basket circumferential outer wall, defining therein a compressed air and fuel axial thru-flow path across an air inlet plane, the thru-flow path having a thru-flow flow direction, and an airflow reversal region upstream of the air inlet plane relative to the thru-flow flow direction;

a plurality of premixers annularly arrayed about a pilot burner, all of which are oriented within the basket interior downstream of the air inlet plane relative to the thru-flow flow direction, and within the thru-flow path;

a flow conditioner coupled to the basket upstream of the air inlet plane and circumscribing the airflow reversal region, the flow conditioner defining an asymmetrical pattern of circumferential perforations that vary circumferential airflow locally from outside the basket into the airflow reversal region;

establishing respective uniform thru-flow path and overall circumferential airflow flow rate specifications common to all of the burners, for achieving defined engine fuel-air ratio (FAR) combustion parameters;

determining actual flow pattern variations in the respective thru-flow path for each respective burner across its respective air inlet plane;

determining a respective flow conditioner asymmetric perforation pattern for each respective burner what will mitigate thru-flow path airflow rate variations, including deviating from the established overall circumferential airflow flow rate specification; and fabricating respective flow conditioners incorporating said respective determined asymmetric perforation pattern for installation in the gas turbine engine.

2. The method of claim 1, further comprising determining a respective flow conditioner asymmetrical perforation pattern for each respective burner that will mitigate flow pattern variations across its respective air inlet plane, while maintaining the individual deviated or established overall circumferential airflow flow rate specification for that burner, when altering localized airflow in the perforation pattern.

3. The method of claim 2, further comprising:

providing a first burner oriented at a twelve o'clock circumferential position in the combustor section;

providing a second burner oriented at a six o'clock circumferential position in the combustor section;

the second burner flow conditioner's entire asymmetrical perforation pattern having greater overall circumferential airflow cross section than the first burner flow conditioner's entire asymmetrical perforation pattern circumferential airflow cross section.

4. The method of claim 1, the asymmetrical perforation pattern of any respective burner varying circumferentially and/or axially along the flow conditioner.

5. The method of claim 1, the asymmetrical perforation pattern of any burner respectively varying perforation cross sectional area, or perforation profile, or perforation density circumferentially and/or axially along the respective flow conditioner.

6. The method of claim 1, the asymmetrical perforation pattern of any burner respectively comprising circular perforations of varying diameter and/or density.

7. The method of claim 1, the asymmetrical perforation pattern of any burner respectively defining first and second circumferential zones on opposite circumferential sides of the flow conditioner, the first circumferential zone having greater circumferential airflow cross section than the second circumferential zone.

8. The method of claim 7, the respective asymmetrical perforation pattern of any burner defining third and fourth circumferential zones on opposite circumferential sides of the flow conditioner intermediate the first and second circumferential zones, respectively having greater circumferential airflow than the second circumferential zone and less circumferential airflow than the first circumferential zone.

* * * * *